United States Patent [19]

Foresman et al.

[11] Patent Number: 4,651,646

[45] Date of Patent: Mar. 24, 1987

[54] IN-LINE SAFING AND ARMING APPARATUS

[75] Inventors: Ralph E. Foresman; Kerry J. Harries, both of Mesa, Ariz.

[73] Assignee: Motorola, Inc., Schaumburg, Ill.

[21] Appl. No.: 836,785

[22] Filed: Mar. 6, 1986

[51] Int. Cl.[4] ..... F42C 11/00; F42C 15/40

[52] U.S. Cl. ..... 102/208; 102/206; 102/218

[58] Field of Search ..... 102/207, 208, 206, 215, 102/218

[56] References Cited

U.S. PATENT DOCUMENTS

| | | | |
|---|---|---|---|
| 2,468,120 | 4/1949 | Senn | 102/208 |
| 2,687,482 | 8/1954 | Harmon et al. | 102/208 |
| 2,990,776 | 7/1961 | Clarke | 102/208 |
| 3,125,027 | 3/1964 | Stoller | 102/208 |
| 3,659,178 | 4/1972 | Gilbert et al. | 320/1 |
| 3,706,022 | 12/1972 | Corey et al. | 320/1 |
| 3,754,996 | 8/1973 | Snyder | 136/90 |
| 3,757,695 | 9/1973 | Fisher | 102/208 |
| 3,821,635 | 6/1974 | Kimmel et al. | 323/102 |
| 3,886,866 | 6/1975 | Fohrmann | 102/218 |
| 3,946,675 | 3/1976 | Stalfors | 102/207 |
| 3,990,370 | 11/1976 | Campagnuolo et al. | 102/208 |
| 4,065,709 | 12/1977 | Sliwa et al. | 102/215 |
| 4,089,268 | 5/1978 | Jaroska et al. | 102/208 |
| 4,421,030 | 12/1983 | DeKoker | 102/206 |
| 4,433,036 | 2/1984 | Horning et al. | 429/114 |
| 4,536,693 | 8/1985 | Marek | 320/1 |
| 4,541,341 | 9/1985 | Fowler et al. | 102/215 |
| 4,542,694 | 9/1985 | Wells | 102/229 |
| 4,559,875 | 12/1985 | Marshall | 102/206 |

*Primary Examiner*—Charles T. Jordan

*Attorney, Agent, or Firm*—Eugene A. Parsons

[57] ABSTRACT

An air driven electrical generator, carried by a weapon, supplies low voltage electrical energy to a storage capacitor which in turn supplies reoccurring constant amounts of electrical energy to the primary of a flyback transformer. The secondary of the flyback transformer supplies relatively high voltage electrical energy to a slapper detonator capacitor.

14 Claims, 4 Drawing Figures

– PRIOR ART –

– PRIOR ART –

IN-LINE SAFING AND ARMING APPARATUS

BACKGROUND OF THE INVENTION

The present invention pertains to safing and arming apparatus for a slapper detonator, which slapper detonator is well-known in the art and, therefore, will only be described briefly. Generally, a slapper detonator is a type of detonator in which a small particle of material is driven, as a result of the application of a very high electrical current, into an explosive charge. The explosive charge, which is relatively stable and not subject to detonation as a result of normal shocks such as dropping and the like, is detonated by the extremely high velocity particle of material. Slapper detonators generally include a relatively large capacitor capable of storing a very high amount of energy at a very high voltage and some type of switching mechanism to rapidly short the capacitor across the active portion of the slapper detonator. Since the slapper detonator is a stable device that can only be activated by the very high current from the associated capacitor, the slapper detonator may be mechanically mounted in-line with the explosive charge and is not considered armed until the capacitor is charged to a predetermined value. Generally, mechanical safing and arming devices contain a relatively unstable explosive charge which is mounted out of line with the main charge and, upon arming, is rotated into line with the main charge. Thus, the slapper detonator is considered an in-line detonator.

In general, because of the extremely high amount of energy required to charge the slapper detonator capacitor and the consequent restraints this places on a power supply, it has been extremely difficult to incorporate the slapper detonator into ordinary projectile fuzes, of conventional weapons such as bombs and missiles. For example, it is common practice to delay the arming of a bomb until safe separation from the release aircraft has occurred. Generally, it is desirable to allow the bomb to drop for some predetermined period of time, such as 5 seconds, before beginning the arming process. It is then desirable for the arming process to require no more than approximately 1/100 of the time the bomb has been falling. Thus, it is necessary to charge the slapper detonator capacitor to the predetermined amount in something less than 50 milliseconds. Since any electrical generator contained on the weapon, such as a battery that starts after firing or dropping the weapon or an air driven electrical generator, produces only small amounts of current at relatively low voltages (generally under 100 volts), it is very difficult to provide the high voltage (10's of kilovolts) and high power required to quickly charge the slapper detonator capacitor.

SUMMARY OF THE INVENTION

The present invention pertains to safing and arming apparatus for a weapon fuze with a slapper detonator wherein an electrical generator is mounted on the weapon for activation in response to predetermined movement of the weapon, a relatively low voltage electrical storage capacitor is connected to the electrical generator for storing electrical energy therefrom, and the primary winding of a flyback transformer is connected to the storage capacitor for receiving reoccurring pulses of electrical energy with the secondary winding of the flyback transformer being connected to the slapper detonator capacitor for supplying relatively high voltage thereto.

It is an object of the present invention to provide new and improved in-line safing and arming apparatus for a weapon fuze with a slapper detonator.

It is a further object of the present invention to provide new and improved in-line safing and arming apparatus for a fuze with a slapper detonator wherein the slapper detonator capacitor is charged the required amount in less than 50 milliseconds.

It is a further object of the present invention to provide in-line safing and arming apparatus for a fuze with a slapper detonator wherein a standard projectile type electrical generator can be utilized to charge the slapper detonator capacitor.

These and other objects of this invention will become apparent to those skilled in the art upon consideration of the accompanying specification, claims and drawings.

BRIEF DESCRIPTION OF THE DRAWINGS

Referring to the drawings.

DESCRIPTION OF THE PREFERRED EMBODIMENT

Figure 1:
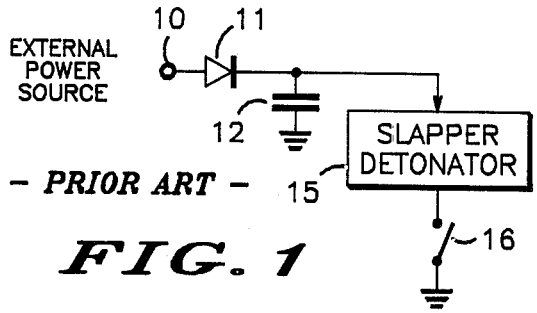
FIG. 1 is a block/schematic drawing of a prior art slapper detonator.

Referring specifically to FIG. 1, a prior art embodiment of a slapper detonator is illustrated. In this prior art embodiment an external terminal 10 supplies the required amount of electrical energy from an external power source through a diode 11 to one terminal of a capacitor 12, the other terminal of which is connected to a common such as ground. The active portion of the slapper detonator is illustrated herein as a box 15, labeled "slapper detonator" for convenience. It will of course be understood by those skilled in the art that the capacitor 12 and an activation switch 16 connected in series with the box 15 is generally considered an integral portion of the slapper detonator, however, the capacitor 12 and switch 16 are illustrated separately herein for convenience in the description of operation.

The slapper detonator embodiment illustrated in FIG. 1 is charged from an external power source so that the large amount of electrical energy required to charge capacitor 12 can be easily and quickly obtained. In general, because of the requirement of an external power source this slapper detonator embodiment cannot be utilized on conventional weapons, such as bombs, missiles, and the like.

Figure 2:
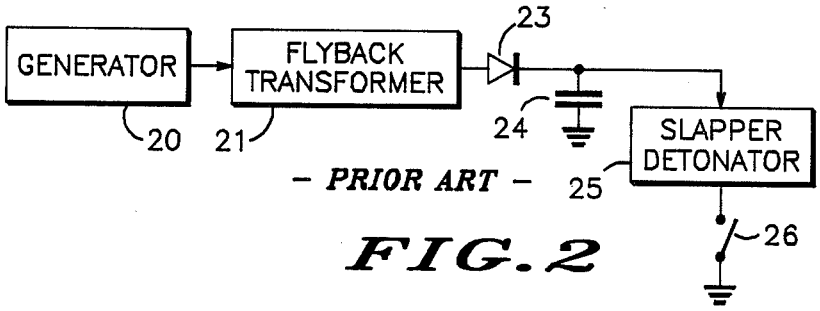
FIG. 2 is a block/schematic drawing of another prior art slapper detonator.

Referring to FIG. 2, a second prior art embodiment of a slapper detonator system is illustrated wherein an electrical generator 20 supplies electrical energy to a flyback transformer 21. The flyback transformer 21 increases the voltage of the energy any desired amount, for example 1,000 times, and supplies the high voltage electrical energy through a rectifier 23 to one terminal of a slapper detonator capacitor 24. Again, the slapper detonator capacitor 24 is connected in parallel with the active portion of the slapper detonator, herein designated 25 and a series connected activation switch 26. While this embodiment of a slapper detonator system appears to be relatively straight forward, one skilled in the art will immediately recognize that generator 20 is little better than the external power source of the embodiment illustrated in FIG. 1. Generator 20 would have to supply an inordinate amount of electrical energy to the primary of flyback transformer 21, because of its internal impedance, to charge capacitor 24 to the required amount in the required time. In fact, while the embodiment illustrated in FIG. 2 as a prior art embodiment has been hypothesized, no such embodiment has ever been built with a generator that can be carried on conventional weapons, such as bombs and missiles.

Figure 3:
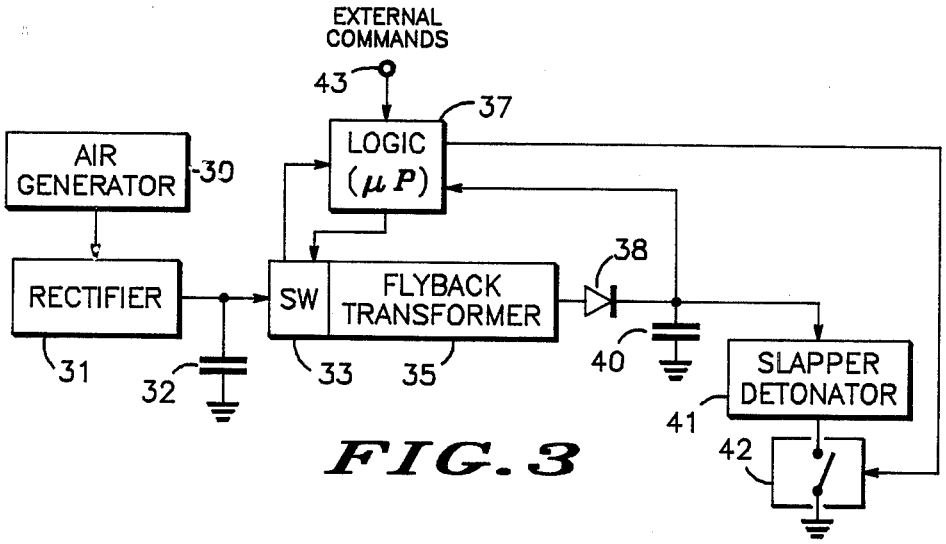
FIG. 3 is a block/schematic diagram of safing and arming apparatus for a fuze with a slapper detonator, incorporating the present invention.

Referring to FIG. 3, a block/schematic diagram of safing and arming apparatus for a slapper detonator, which can be completely incorporated in a weapon is illustrated. In this embodiment a standard low voltage air generator 30 is utilized. Air generator 30 may be, for example, the type disclosed in: U.S. Pat. No. 2,468,120, issued Apr. 26, 1949: U.S. Pat. No. 2,990,776, issued July 4, 1961: or U.S. Pat. No. 3,757,695, issued Sept. 11, 1973. For any of these air driven generators to be practical, it is necessary that they be constructed relatively small and, therefore, that they produce relatively low voltage electrical energy. It should be noted that while an air generator is designated as the electrical generator in this embodiment, other types of electrical generators might be mounted on the weapon and utilized in the present safing and arming apparatus, some examples of which electrical generators are the batteries disclosed in U.S. Pat. No. 3,754,996, issued Aug. 28, 1973, and in U.S. Pat. No. 4,433,036, issued Feb. 21, 1984. In the event that air generator 30 supplies an alternating current at the output thereof, a rectifier 31 may be connected to receive the output and supply a DC voltage to one terminal of an electrical storage capacitor 32. The opposite terminal of capacitor 32 is connected to a common point such as ground or the like. Capacitor 32 is a relatively low voltage capacitor, generally under 100 volts, so that it can be charged substantially to its full capacity by the electrical energy from generator 30 within a known period of time, such as 2 seconds. Assuming that the weapon carrying the safing and arming apparatus illustrated in FIG. 3 is a bomb and generator 30 is an air driven generator, capacitor 32 will begin to charge as soon as the bomb is released and air generator 30 is activated and will have a period of time in the range of 5 seconds to charge before arming of the bomb is initiated. Thus, capacitor 32 can be any convenient size that can be charged to the desired level within the period of time from the actual dropping of the bomb until initiation of arming.

Capacitor 32 is in turn connected through a switch 33 to a flyback transformer 35. In general, switch 33 is considered an interal portion of the flyback transformer 35 since, as is well known in the art, flyback transformer 35 will not operate unless switched in accordance with the theory of operation thereof. The amount of current flowing through switch 33 and the primary of flyback transformer 35 is in turn sensed and supplied to logic circuitry 37, which may simply be a microprocessor or the like. Logic circuitry 37 then supplies a control signal to switch 33 for the reoccurring operation thereof. Output electrical energy from flyback transformer 35 is supplied through a diode 38 to a slapper detonator capacitor 40. Slapper detonator capacitor 40 is in turn connected in parallel with the active element of the slapper detonator, herein illustrated as box 41, and a series connected activation switch 42. The voltage across capacitor 40 is sensed and supplied to logic circuitry 37 for a determination as to when switch 33 may be deactivated. Also, external commands are supplied to logic circuitry 37 by way of a terminal 43 and fire commands are supplied by logic circuitry 37 to switch 42.

It will be seen that capacitor 32 is actually operating as the power supply to drive flyback transformer 35. When switch 33 connects capacitor 32 across the primary winding of flyback transformer 35 the extreme low impedance that flyback transformer 35 sees effectively removes air generator 30 and rectifier 31 from the circuit. Thus, current flows from capacitor 32 and builds up to a desired amount very rapidly. Also, because of the low internal impedance of capacitor 32 operating as a power supply, very little energy is wasted and the total energy required from air generator 30 is substantially reduced.

Figure 4:
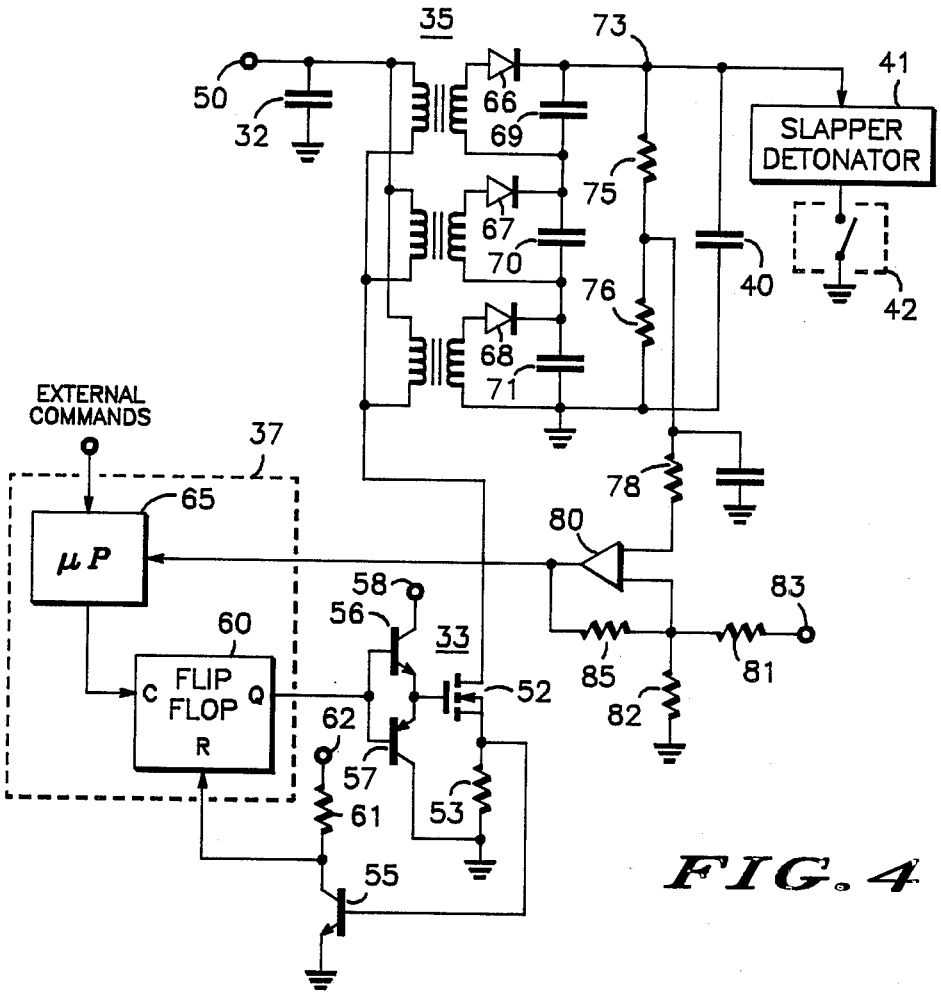
FIG. 4 is a more detailed schematic diagram of a portion of the apparatus illustrated in FIG. 3.

A more complete understanding of the operation of the present invention can be obtained by referring to the schematic diagram of FIG. 4. The apparatus of this schematic diagram is essentially the same as the simplified block diagram of FIG. 3, with portions thereof not included. an input terminal 50 is connected to the output of an on-board electrical generator, such as air generator 30 and rectifier 31 of FIG. 3. So that the schematic of FIG. 4 may be correlated with the block diagram of FIG. 3, like parts are indicated with like numbers throughout the description. Terminal 50 is connected to one side of electrical storage capacitor 32, the other side of which is connected to ground. The one side of capacitor 32 is also connected to one side of each of three primary windings of flyback transformer 35. The other side of each of the primary windings are connected together and to the drain of an N channel MOSFET transistor device 52. The source of transistor 52 is connected through a resistor 53 to ground. The source is also connected to the base of a transistor 55, which acts as a current sensing device. The gate of transistor 52 is connected to the emitters of a complimentary connected pair of transistors 56 and 57. The emitters and the bases of transistors 56 and 57 are connected together. The collector of transistor 56 is connected to a terminal 58 adapted to have a positive source of voltage applied thereto and the collector of transistor 57 is connected to ground. The interconnected bases of transistors 56 and 57 are connected to the Q output of a flip-flop 60. Transistor 52 switches the current drawn through the primary windings of flyback transformer 35 from capacitor 32 and along with transistors 56 and 57 forms the switch 33 illustrated in block form in FIG. 3.

As current is drawn through the three parallel primary windings of flyback transformer 35 and transistor 52, it flows through resistor 53 to ground. The voltage at the upper end of resistor 53 (the source of transistor 52) is an indication of the current flowing through the primary windings of flyback transformer 35 and is supplied to the base of transistor 55. The emitter of transistor 55 is connected to ground. The collector is connected through a resistor 61 to a terminal 62 adapted to have a positive source of voltage applied thereto. Eventually, the voltage applied to the base of transistor 55 will turn transistor 55 on causing the voltage at the collector thereof to drop sharply, this transition is applied to reset flip-flop 60. When flip-flop 60 is reset the Q output thereof drops causing transistor 52 to turn off so that current no longer flows through the primaries of flyback transformer 35 and the energy stored electromagnetic field begins to collapse and provide the flyback action. At some time subsequent to the flyback action a microprocessor 65 supplies a clock pulse to flip-flop 60 which again produces a Q output, thereby turning on transistor 52.

Flyback transformer 35 has three secondary windings, one for each primary winding, each of which has a diode 66, 67, or 68 connected in series therewith and a capacitor 69, 70, or 71 connected in parallel across the secondary winding and diode. The three capacitors 69, 70, and 71 are connected in series between a terminal 73 and ground. Slapper detonator capacitor 40 is connected in parallel with the three capacitors 69, 70, and 71 between terminal 73 and ground. Also, slapper detonator 41 and activation switch 42 are connected in series between terminal 73 and ground. Since the voltage across each of the secondary windings is only approximately one-third of the voltage across the entire secondary, or the voltage applied to slapper detonator capacitor 40, the size of capacitor 69, 70, and 71 is relatively small compared to slapper detonator capacitor 40.

In effect, capacitors 69, 70, and 71 are filter capacitors which simply convey the output energy to slapper detonator capacitor 40. In general, slapper detonator capacitor 40 is a relatively large capacitor, in the range of approximately 10's of kilovolts, and takes a large number of pulses of stored energy from capacitor 32 to attain the desired charge. Since the time it takes to charge slapper detonator capacitor 40 to the required amount is crucial, this time must be minimized as much as possible. In the present invention the time is minimized by sensing the amount of current flowing through the primaries of flyback transformer 35 and deactivating switch 33 each time the current reaches a predetermined amplitude. This sensing of the current insures a constant energy in each pulse from storage capacitor 32. Since the voltage level of the energy stored in capacitor 32 may be reduced as slapper detonator capacitor 40 is charged, the amount of current flowing through the primaries of flyback transformer 35 in a given period of time will be reduced. Therefore, to insure constant energy in each pulse the time current is allowed to flow from capacitor 32 through the primaries of flyback transformer 35 must vary. Also, it is desirable that the current flowing in the primaries of flyback transformer 35 never reaches sufficient proportions to cause flyback transformer 35 to go into saturation. Current sensing transistor 55 achieves these goals by causing flip-flop 60 to turn-off transistor 52 at the same current level each pulse, which current level is just prior to flyback transformer 35 going into saturation.

A pair of resitors 75 and 76 are connected in series between terminal 73 and ground with the junction of the two resistors being connected through a current limiting resistor 78 to one input of a comparator 80. A pair of resistors 81 and 82 are connected in series between a terminal 83 adapted to have a positive source of voltage applied thereto and ground, with the junction of the resistor being connected to a second input of comparator 80. The junction of resistors 81 and 82 is also connected through a resistor 85 to the output of comparator 80. The comparator 80 and its associated circuitry is a voltage sensor, the output of which is connected to an input of microprocessor 65. When the voltage across slapper detonator capacitor 40 reaches a predetermined value a signal is supplied by comparator 80 to microprocessor 65 which then stops supplying clock pulses to flip-flop 60 and, accordingly, stops the operation of flyback transformer 35 and any subsequent application of energy to slapper detonator 40.

Because of the current and voltage sensing circuitry for providing the largest possible pulses of energy to slapper detonator capacitor 40 until it is charged to the required amount, the present apparatus achieves the task of charging slapper detonator capacitor 40 in the minimum amount of time. Also, the novel circuitry allows the use of a standard electrical generator mounted on the projectile rather than the external or unachievable generators of the prior art. Because a standard electrical generator, such as a pop-up air generator, reserve battery, or the like, can be used in conjunction with the present safing and arming apparatus, this novel apparatus can be incorporated in virtually any weapon fuze. Thus, in-line safing and arming apparatus can be utilized in weapons rather than the standard out of line mechanical safing and arming apparatus to greatly improve the safety and handling requirements of the weapons.

While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

What is claimed is:

1. In-line safing and arming apparatus for a weapon having a fuze with a slapper detonator including an activation switch and a relatively high voltage capacitor, said apparatus comprising:

an electrical generator mounted on the weapon for activation in response to predetermined movement of the weapon;

a relatively low voltage electrical storage capacitor connected to receive and store electrical energy from said electrical generator; and a flyback transformer having a primary winding connected to receive the stored electrical energy from said low voltage capacitor and a secondary winding connected to transfer the received electrical energy to the high voltage capacitor at a substantially increased voltage.

2. In-line safing and arming apparatus as claimed in claim 1 wherein the electrical generator is a wind driven generator.

3. In-line safing and arming apparatus as claimed in claim 1 wherein switching means are connected in circuit with the electrical generator, the low voltage capacitor, and the primary winding of the flyback transformer for periodically discharging electrical energy stored in said low voltage capacitor through the primary winding of said flyback transformer.

4. In-line safing and arming apparatus as claimed in claim 3 wherein a rectifier is connected in circuit with the secondary winding of the flyback transformer and the high voltage capacitor.

5. In-line safing and arming apparatus as claimed in claim 3 wherein the switching means includes a current sensor connected to sense current flowing in the primary winding of the flyback transformer and further including a switch connected to said primary winding for controlling current flowing therethrough, said current sensor being coupled to control said switch to deactivate said switch when the current flowing in the primary winding reaches a predetermined value.

6. In-line safing and arming apparatus as claimed in claim 5 including logic circuitry connecting the current sensor to the switch for control thereof.

7. In-line safing and arming apparatus as claimed in claim 6 wherein the logic circuitry is a microprocessor connected to supply a reoccurring control signal to the switch, the time of reoccurrence being controlled by signals from the current sensor.

8. In-line safing and arming apparatus as claimed in claim 7 including in addition a voltage sensor connected to the high voltage capacitor for sensing the voltage thereacross, said voltage sensor being connected to the microprocessor to stop the reoccurring control signal when the voltage across the high voltage capacitor reaches a predetermined amplitude.

9. In-line safing and arming apparatus as claimed in claim 1 wherein the flyback transformer includes a plurality of primary windings and a plurality of secondary windings.

10. In-line safing and arming apparatus for a weapon fuze comprising;

a slapper detonator including an activation switch and a relatively high voltage capacitor;

an electrical generator mounted on the weapon for activation in response to predetermined movement of the weapon;

a relatively low voltage electrical storage capacitor connected to receive and store electrical energy from said electrical generator;

a flyback transformer having a primary winding connected to said low voltage capacitor and a secondary winding connected to transfer the received electrical energy to the high voltage capacitor at a substantially increased voltage;

a switch coupled to the primary winding of said flyback transformer to control the application of stored electrical energy from said low voltage capacitor to the primary winding of said flyback transformer;

a first sensor coupled to the primary winding of said flyback transformer, said first sensor providing output signals indicative of the amount of electrical energy supplied to the primary winding of said flyback transformer; and logic circuitry coupled to supply a reoccurring activation signal with a variable duration to said switch and further coupled to receive the output signals from said first sensor to control the duration of the activation signals so the electrical energy supplied to the primary winding of said flyback transformer for each reoccurring activation signal is substantially constant.

11. In-line safing and arming apparatus as claimed in claim 10 including in addition a second sensor coupled to the secondary winding of the flyback transformer and providing an output signal indicative of the amount of voltage across the high voltage capacitor, said second sensor being coupled to supply the output signal to the logic circuitry to stop the reoccurring activation signal when the amount of voltage across the high voltage capacitor reaches a predetermined amplitude.

12. In-line safing and arming apparatus as claimed in claim 11 wherein the primary winding of the flyback transformer includes a plurality of windings connected in parallel and the secondary winding of the flyback transformer includes a plurality of windings connected in series.

13. In a weapon fuze, a method of supplying a relatively high voltage, high amount of electrical energy to a slapper detonator capacitor from a relatively low voltage electrical generator mounted on the weapon, comprising the steps of:

storing low voltage electrical energy from said low voltage electrical generator;

providing a flyback transformer designed to provide electrical energy at an output thereof with a substantially increased voltage in response to electrical energy supplied to an input thereof;

supplying substantially constant amounts of the stored low voltage electrical energy on reoccurring intervals to the input of the flyback transformer; and connecting the electrical energy at the output of the flyback transformer to the slapper detonator capacitor.

14. A method as claimed in claim 13 including in addition the steps of sensing the amount of electrical energy supplied to the slapper detonator capacitor and stopping the supplying of electrical energy to the input of the flyback transformer when the sensed amount reaches a predetermined value.

* * * * *